US007413077B2

(12) United States Patent
Rydberg et al.

(10) Patent No.: US 7,413,077 B2
(45) Date of Patent: Aug. 19, 2008

(54) TRANSPORT PACKAGE FOR A BOAT PROPELLER DRIVE

(75) Inventors: Anders Rydberg, Arboga (SE); Goran Gustafson, Kolsva (SE)

(73) Assignee: Volvo Penta AB, Gothenburg (SE)

( * ) Notice: Subject to any disclaimer, the term of this patent is extended or adjusted under 35 U.S.C. 154(b) by 7 days.

(21) Appl. No.: 11/164,469

(22) Filed: Nov. 23, 2005

(65) Prior Publication Data

US 2006/0196806 A1 Sep. 7, 2006

Related U.S. Application Data

(63) Continuation of application No. PCT/SE2004/000666, filed on Apr. 30, 2004, now abandoned.

(30) Foreign Application Priority Data

May 23, 2003 (SE) ..... 0301521

(51) Int. Cl.
*B65D 85/68* (2006.01)

(52) U.S. Cl. ..... 206/319; 206/600

(58) Field of Classification Search ..... 206/600, 206/319, 335, 595, 598, 386, 784, 499; 220/4.28, 220/8; 248/640
See application file for complete search history.

(56) References Cited

U.S. PATENT DOCUMENTS

| | | | | |
|---|---|---|---|---|
| 4,938,350 | A * | 7/1990 | Grigsby | 206/319 |
| 5,791,955 | A | 8/1998 | Rinck | |
| 5,857,660 | A | 1/1999 | Lentine | |
| 6,019,226 | A * | 2/2000 | Zajdlik et al. | 206/600 |

* cited by examiner

*Primary Examiner*—Mickey Yu
*Assistant Examiner*—Steven A. Reynolds
(74) *Attorney, Agent, or Firm*—Novak Druce + Quigg LLP

(57) ABSTRACT

A transport package for a boat propeller drive (2) that has a suspension fork (6) for suspending the drive in a suspension plate mounted on the stern transom of a boat. The package includes a bottom plate (14) and a cover that can be removed from the bottom plate. The drive is held in a fixed position in the package by means of upper and lower spacing elements (21, 22). When the cover and the upper spacing elements are removed, the suspension fork is exposed and the drive is held stable in an upright position by the bottom plate together with the lower spacing elements to serve as a mounting fixture.

6 Claims, 3 Drawing Sheets

TRANSPORT PACKAGE FOR A BOAT PROPELLER DRIVE

CROSS-REFERENCE TO RELATED APPLICATIONS

The present application is a continuation patent application of International Application No. PCT/SE2004/000666 filed 30 Apr. 2004 which was published in English pursuant to Article 21(2) of the Patent Cooperation Treaty, and which claim priority to Swedish Application No. 0301521-1 filed 23 May 2003. Said applications are expressly incorporated herein by reference in their entireties.

TECHNICAL FIELD OF THE INVENTION

The present invention relates to a transport package for a boat propeller drive of the type that has an upper gear case enclosing a bevel gear, a drive shaft assembly projecting downwards from the gear case, and means for suspending the propeller drive on a suspension element fixed on the stern transom of the hull of a boat, which package forms a casing, which encloses the drive on all sides and contains spacing elements that hold the drive in position in the casing.

BACKGROUND OF THE INVENTION

To date, propeller drives of the type described above have been packaged in ordinary rectangular boxes that have a bottom which is attached to four sides of the box, and each of which is joined to a flap. The flaps combine to form the lid of the box and are stapled and/or taped together to close the box after the propeller drive has been placed inside. Spacing elements have typically been included for holding the propeller drive in position while in the box. To date, a number of polystyrene elements have been used and which in various places fill out the space between the drive and the sides of the box. Prior to aligning and suspending the drive on the stern of the boat, the packaging around the drive must be removed in its entirety. This means that the box must first be opened and a number of the polystyrene elements removed so that the drive is exposed and can be lifted out of the box either by hand or using a hoist. Drives of this type can weigh up to 175 pounds (eighty kilograms) requiring at least two people to lift out the drive by hand.

The work of lifting the drive by hand is heavy and, as the installation requires accurate alignment, the work is difficult and uncertain. Even when using a lifting yoke suspended in a hoist which makes it possible for one person to carry out the installation, it is still difficult to finding the correct suspension points so that the drive is correctly balanced in order to prevent problems from arise with respect to aligning the drive with the suspension element on the stern.

SUMMARY OF THE INVENTION

An object of the present invention is to achieve a transport package of the type described in the introduction, which can also be utilized as a mounting fixture in order thereby to make it possible for a single person to carry out the whole process of mounting the drive, from the opening of the package to the alignment and mounting of the drive on the suspension element, without the use of a lifting yoke suspended in a hoist and without physical exertion.

This is achieved according to the invention by means of the casing consisting of at least two parts that can be separated from each other. One part has a flat bottom plate which forms a horizontal lower support surface when the casing is oriented in such a way that the drive stands upright with the gear case and the suspension means facing upwards. The other part forms a cover which, together with first spacing elements, can be separated from the bottom plate in order to expose the suspension means or arrangement. The bottom plate and second spacing elements are arranged and dimensioned so that after the removal of the cover and the first spacing elements, the bottom plate and the second spacing elements can be utilized as a mounting fixture for holding the drive in a position that is suitable for connection of the suspension means or arrangement to the suspension element.

Designs according to the invention thus make it possible to open the package in such a way that it provides good support for the drive in all directions, even when large parts of the packaging have been removed and the suspension means is exposed. The flat bottom plate with remaining spacing elements means that the drive stands steady on the base. Before the cover is removed and the first spacing elements are removed, the package can be placed, for example, on a pallet trolley, and by means of which the drive can be easily installed at the correct installation height and in the correct lateral position after the cover and the first spacing elements have been removed. According to the invention, a mounting fixture is obtained which is particularly advantageous to use for the mounting of drives on boats that have a bathing platform at the stern. In such a situation, it has not previously been possible to use a hoist as an aid when mounting a drive, as the drive cannot be lowered from above into the mounting position, due to the platform being in the way.

BREIF DESCRIPTION OF THE DRAWINGS

The invention will be described in greater detail with reference to exemplary embodiments shown in the accompanying drawings, in which.

DETAILED DESCRIPTION

Figure 1:
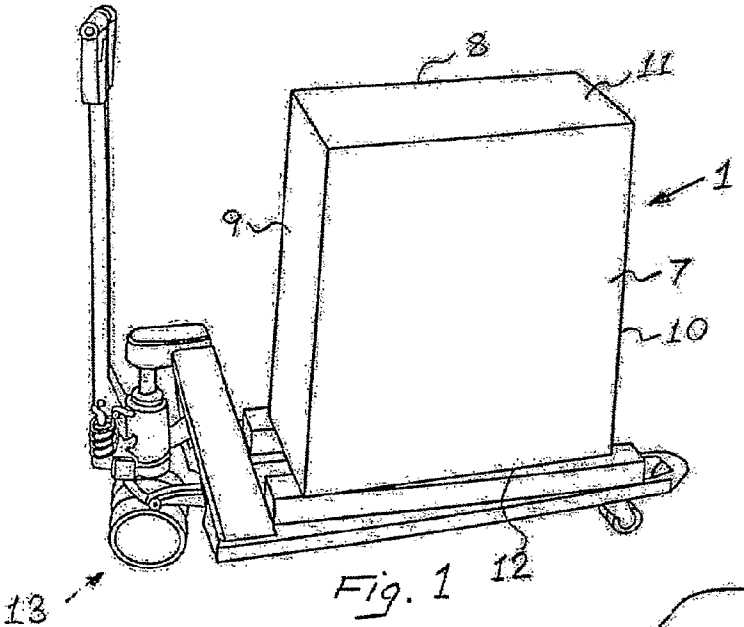
FIG. 1 shows a schematic perspective view of an embodiment of a transport package according to the invention.
Figure 3:
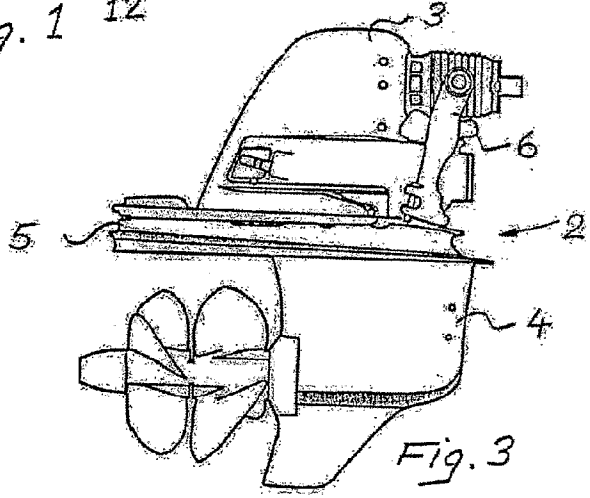
FIG. 3 shows a side view of a boat propeller drive.

The package designated in general by the reference numeral 1 in FIG. 1 is intended in particular for a boat propeller drive 2 of the type which is shown in FIG. 3, and which comprises (includes but is not necessarily limited to) an upper gear case 3, a drive shaft assembly 4 projecting downwards from the gear case, a cavitation plate 5 located between the gear case and the drive shaft assembly, and a suspension fork 6 for pivotal suspension of the drive on a suspension plate (not shown) mounted on the stern of a boat.

Figure 2:
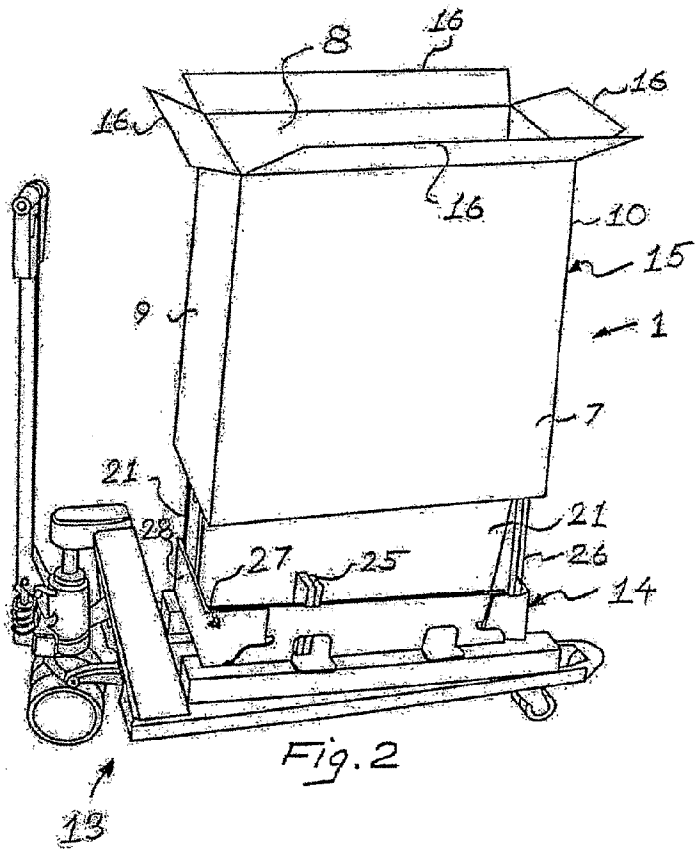
FIG. 2 shows a view corresponding to FIG. 1 with the package partially opened.

The package 1 is in the shape of a parallelepiped with opposing parallel transverse sides 7,8 opposing parallel front and rear sides 9,10 and opposing parallel upper and lower sides 11,12. The material for the sides is preferably corrugated board (cardboard). In FIGS. 1 and 2, the package 1 is placed on a pallet trolley 13. The transverse sides 7,8 are provided with handles (not shown) at a suitable height, which make it possible for two people, one on each side of the package, to lift up the package 1 onto the trolley 13 relatively easily before it is opened.

As shown in FIG. 2, the package consists of two main parts, namely a bottom part 14 and a cover 15. The upper side 11 of the cover 15 is formed by four flaps 16 joined to the sides 7, 8, 9 and 10 in such a way that they hinge so that the upper side 11 can be opened and loose components enclosed in the package in association with a propeller drive 2 enclosed in the package can first be removed before the cover 15 is lifted off the bottom part 14.

Figure 4:
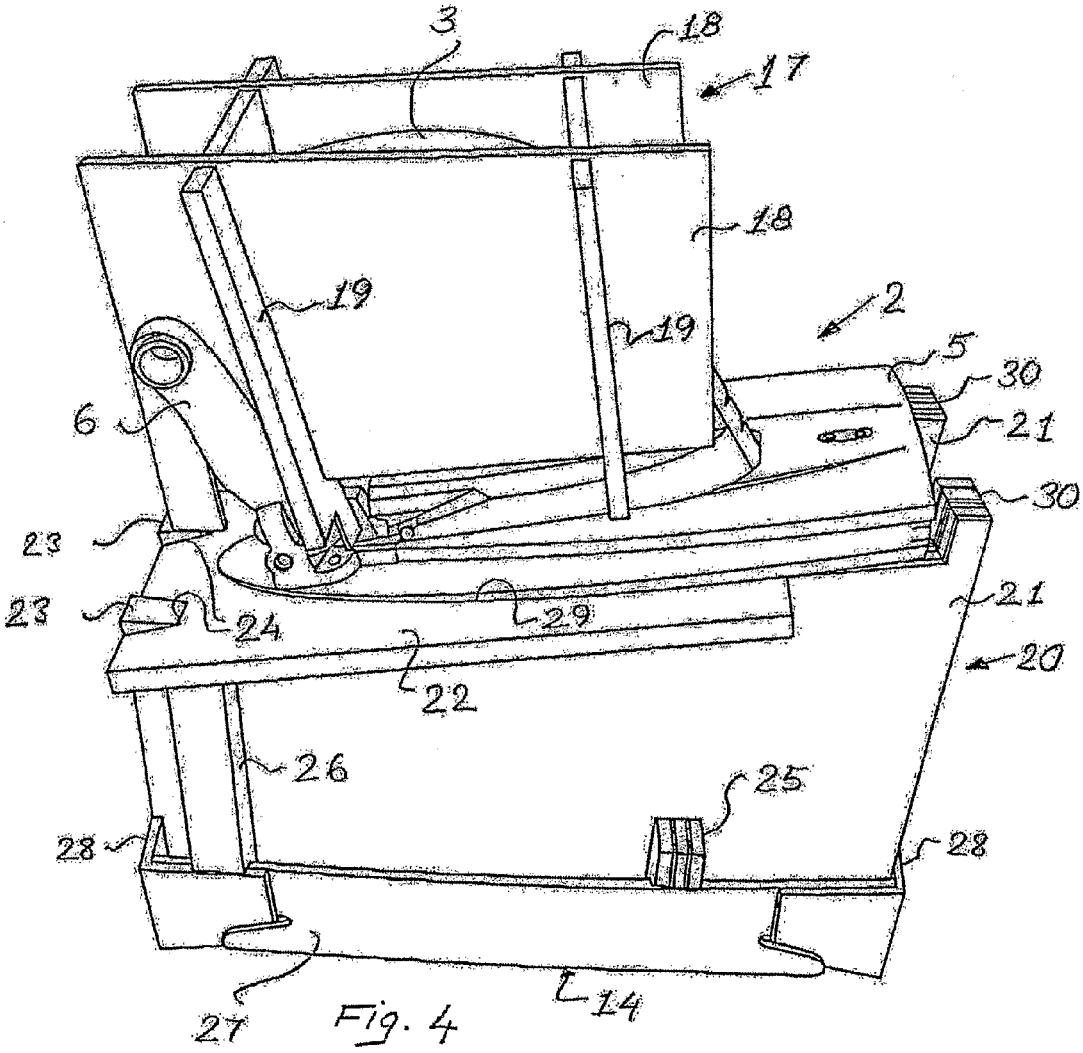
FIG. 4 shows a perspective view of an opened package containing a propeller drive as shown in FIG. 3.

When the cover 15 has been removed (see FIG. 4), the upper spacing elements 17 surrounding the gear case 3 are exposed. Exemplarily, the upper spacing elements consist of two longitudinal and two transverse sheets 18 and 19, respectively, that are joined together and are made of laminated corrugated board. The bottom part 14, together with associated lower spacing elements 20, are exposed. The lower spacing elements comprise two vertical sheets 21 arranged on each side of the drive shaft assembly 4 and a sheet 22 between the two vertical sheets that is inclined slightly towards a horizontal plane; preferably, these sheets also consist of laminated corrugated board.

The upper edges of the sheets 21 are designed with cutouts matching the thickness and length of the sheet 22, in which cutouts the sheet 22 rests.

Figure 5:
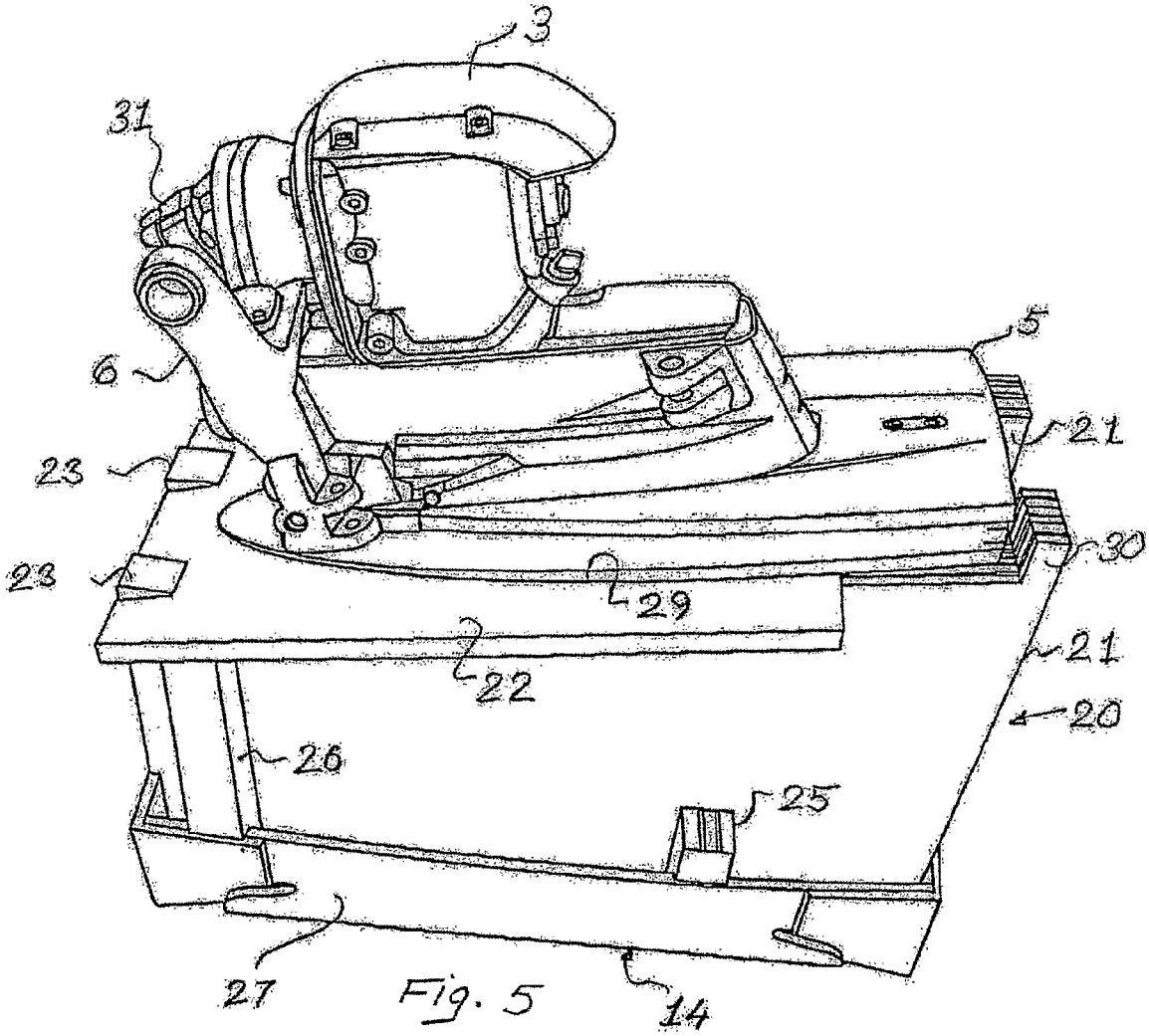
FIG. 5 is a view corresponding to FIG. 4 with the upper part of the propeller drive and associated suspension device exposed.

Parts 23 of the sheets 21 are inserted in turn into cutouts 24 in the front edge of the sheet 22. The sheets 21 are fixed in a transverse direction relative to the bottom part 14 by means of blocks 25,26 which are inserted between a low edge part 27 of the bottom part 14 and the outside of the sheets 21. In the longitudinal direction, the sheets are fixed between the short sides 28 of the edge parts 27. The distance between the insides of the sheets 21 is matched to the largest dimension of the drive shaft assembly 4 in a transverse direction so that the sheets 21, together with a cutout 29 in the sheet 22 (which cutout has a shape matching the outline of the cavitation plate 5, and parts 30 of the sheets 21 projecting upwards at the back edge of the cavitation plate 5) act together to keep the drive fixed upright in the position shown in FIGS. 4 and 5; that with the underside of the cavitation plate 5 resting against the upper edge of the sheets 21.

When the upper spacing element 17 has been removed (see FIG. 5), the gear case 3 with associated drive pickup point 31 and suspension fork 6 are exposed and the drive can be moved easily to the correct lateral position in relation to a suspension plate mounted on the stern of a boat, while the drive is on, for example, a pallet trolley. Thereafter, using the pallet trolley the drive can be raised to the correct level and finally moved forward so that the drive pickup point can be connected to the outgoing shaft of the motor and the suspension fork 6 can be connected to pins on the suspension plate. In the embodiment shown, the sheet 22 is inclined forwards/downwards approximately 8° towards the horizontal plane. This places the suspension fork 6 in an ideal position in relation to the pins on the suspension plate for mounting the propeller drive.

Package(s) configured according to the invention have been described above with reference to a preferred embodiment, but both the material and the shape of the individual components in the package can vary within the framework of the invention, provided that the main provision is fulfilled; namely that certain parts of the package can be removed in order to expose the drive's suspension means (arrangement) while at the same time the remaining parts of the package are sufficiently stable to hold the drive in a predetermined position for mounting.

What is claimed is:

1. A transport package, comprising:

a casing; and a boat propeller drive unit disposed within said casing in an upright position, said boat propeller drive unit forming at least a portion of the outboard portion of an inboard/outboard boat propulsion assembly and comprising an upper gear case enclosing a bevel gear therein;

a drive shaft assembly extending downwardly from the upper gear case; and a suspension assembly by means of which the boat propeller drive unit can be suspended on a suspension element fixed on the stern of a boat;

wherein said casing comprises lower and upper casing parts, said lower casing part comprising 1) a flat bottom plate that forms a horizontal lower support surface on which the transport package may be supported with the boat propeller drive unit disposed in said upright position and 2) first spacing elements that at least partially shroud the drive shaft assembly within the lower casing part and that support the propeller drive unit in said upright position; and said upper casing part comprising 1) a cover and 2) second spacing elements that at least partially shroud the upper gear case, said cover and said second spacing elements being separable from the lower casing part;

whereby the upper casing part can be removed from the lower casing part to expose the suspension assembly and the lower casing part will continue to support the boat propeller drive unit in the upright position so that the suspension assembly can be attached to the suspension element on the stern of the boat.

2. The transport package according to claim 1, wherein the casing is in the shape of a parallelepiped and said cover is five-sided with a height, length and width matched to the height, length and width of the boat propeller drive unit and said bottom plate has a corresponding length and width.

3. The transport package according to claim 1, wherein the bottom plate has a low edge that projects upwards which, when the casing is closed, is enclosed inside the cover and which, when the cover is removed, forms a lateral support for the first spacing elements.

4. The transport package according to claim 1, wherein the drive shaft assembly of the boat propeller drive unit includes a cavitation plate and the first spacing elements comprise two sheets oriented in the longitudinal direction of the boat propeller drive unit and fixed on the bottom plate on both sides of the drive shaft assembly, which two sheets support between them a third sheet with a cutout that has a shape matched to the outline of the cavitation plate.

5. The transport package according to claim 4, wherein the third sheet is fixed at a slight incline in relation to the bottom plate.

6. The transport package according to claim 1, wherein at least the bottom plate and the first spacing elements consist of laminated corrugated board.

* * * * *